US005809804A

United States Patent [19]

Kuhrau et al.

[11] Patent Number: 5,809,804

[45] Date of Patent: Sep. 22, 1998

[54] SLIVER KNITTING MACHINE CARD UNIT AND AIR NOZZLE

[75] Inventors: Michael K. Kuhrau; Donald Charles Fosselman, both of Orangeburg, S.C.

[73] Assignee: Mayer Industries, Inc., Orangeburg, S.C.

[21] Appl. No.: 834,947

[22] Filed: Apr. 7, 1997

Related U.S. Application Data

[60] Division of Ser. No. 665,476, Jun. 17, 1996, Pat. No. 5,685,176, which is a continuation-in-part of Ser. No. 540, 060, Oct. 6, 1995, Pat. No. 5,546,768.

[51] Int. Cl.[6] ..... D04B 9/14

[52] U.S. Cl. ..... 66/9 B

[58] Field of Search ..... 66/9 B

[56] References Cited

U.S. PATENT DOCUMENTS

| | | | |
|---|---|---|---|
| 672,182 | 4/1901 | Sedmihradsky . | |
| 2,255,078 | 9/1941 | Moore . | |
| 2,280,535 | 4/1942 | Moore . | |
| 2,953,912 | 9/1960 | Hill . | |
| 3,014,355 | 12/1961 | Hill | 66/9 B |
| 3,021,698 | 2/1962 | Hill . | |
| 3,045,459 | 7/1962 | Hill . | |
| 3,226,952 | 1/1966 | Cassady . | |
| 3,295,337 | 1/1967 | Beucus et al. | 66/9 B X |
| 3,299,672 | 1/1967 | Schmidt . | |
| 3,461,689 | 8/1969 | Herkenberg | 66/9 B |
| 3,523,429 | 8/1970 | Herkenberg | 66/9 B |
| 3,710,597 | 1/1973 | Schmidt . | |
| 3,728,872 | 4/1973 | Thore . | |
| 4,006,609 | 2/1977 | Abler | 66/9 B |
| 4,050,267 | 9/1977 | Schaab et al. . | |
| 4,187,700 | 2/1980 | Koegel . | |
| 4,244,198 | 1/1981 | Schaab et al. . | |
| 4,245,487 | 1/1981 | Schaab et al. | 66/9 B |
| 4,364,243 | 12/1982 | Kunde | 66/9 B |
| 4,532,780 | 8/1985 | Tilson et al. | 66/9 B |
| 4,563,884 | 1/1986 | Kunde et al. . | |
| 5,134,863 | 8/1992 | Hanna . | |
| 5,431,029 | 7/1995 | Kuhrau et al. . | |

*Primary Examiner*—John J. Calvert

*Attorney, Agent, or Firm*—Bell Seltzer Intellectual Property Law Group of Alston & Bird LLP

[57] ABSTRACT

A circular sliver knitting machine comprising an air supply unit for supplying air to the circular sliver knitting machine. A first air nozzle unit cooperating with a card unit for directing air along a path generally radially outward toward the knitting needles and a second air nozzle unit cooperating with the card unit for directing air along a path generally radially inward toward the needles. An air distributing unit is provided for distributing air received from the air supply unit to at least one of the first air nozzle unit and the second air nozzle unit.

4 Claims, 11 Drawing Sheets

SLIVER KNITTING MACHINE CARD UNIT AND AIR NOZZLE

RELATED APPLICATION

This application is a divisional of application Ser. No. 08/665,476, filed Jun. 17, 1996, U.S. Pat. No. 5,685,176 which is a continuation-in-part of Ser. No. 08/540,060, filed Oct. 6, 1995 U.S. Pat. No. 5,546,768.

FIELD OF THE INVENTION

The present invention relates to the field of sliver knitting, and, more particularly to, an apparatus and method for knitting reverse loop sliver knit fabric.

BACKGROUND OF THE INVENTION

The manufacture of reverse loop sliver knit fabric using a circular sliver knitting machine for producing a pile fabric is well known in the art. Typically, a doffer roll is used to receive the sliver fiber from a card unit. Needles mounted on a rotatable cylinder receive the sliver fibers from a doffer roll as hooks on the needles enter the fillet wire of the doffer roll and draws sliver fibers after the needles have risen to a clearing level along a predetermined wave-like path. The hooks of the needle also pick up a yarn which is used to anchor or secure the sliver fibers such that free ends of the sliver fibers project from one side of the fabric. Examples of this approach to knitting pile fabric may be seen in U.S. Pat. Nos. 3,299,672 and 3,710,597 to Schmidt.

Schaab et al. in U.S. Pat. Nos. 4,244,198 and 4,245,487 and Kuhrau et al. in U.S. Pat. No. 5,431,029 which have been assigned to the applicant of the present invention each disclose a method and apparatus for making reverse loop sliver knit fabric which is a significant departure from the traditional manufacturing techniques described above. The traditional manufacturing method reverse loop sliver knit fabric resulting in a single knitting of the sliver fibers into the base fabric. This results in a pile fabric which is both long and has an uneven length. It is therefore necessary to finish the product by shearing the pile to the desired height and napping or brushing the sheared pile to minimize any flaws in the fabric.

Schaab et al. and Kuhrau et al. knit the sliver fabric into a typical J-loop or U-loop on the first pass of the needles in accordance with the previously described techniques. However, unlike previous methods, Schaab, et al. and Kuhrau et al. each use an air nozzle which is positioned radially inward from the needles and sinkers. The purpose of the air nozzle is to turn the free ends of the sliver, previously knitted into the base fabric during the first pass of the needles, over the sinkers so that the remaining free ends, assuming that they are of sufficient length, will be knitted a second time or interlaced into the fabric. The result is that the length of the free ends remaining after the second pass is shortened and as a consequence, the pile will be shorter, therefore, less waste will occur as result of shearing.

In addition to using a circular sliver knitting machine to knit reverse loop sliver fabric, it is common to knit fabric having a high or deep pile. Examples of such uses of a circular sliver knitting machine may be seen in U.S. Pat. Nos. 3,728,872 to Thore, 4,050,267 to Schaab et al., and 4,187,700 to Koegel. Typically, a circular sliver knitting machine which is used to manufacture high pile fabric uses air nozzle units located radially outward of the needles so as to blow air radially inward (see for example U.S. Pat. No. 4,187,700 to Koegel and Italian Patent No. 710,949).

Unfortunately, the arrangement of the air nozzle units on a circular sliver knitting machine used to manufacture a reverse loop sliver fabric typically are located radially inward from the needles so as to blow air radially outward (see for example U.S. Pat. Nos. 4,244,198 and 4,245,487 to Schaab et al. and U.S. Pat. No. 5,431,029 Kuhrau et al.). As a result, considerable down time and modification of the machine is necessary to convert the machine redirect the air flow and relocate the air nozzle units so as enable the circular sliver knitting machine to knit conventional high or deep pile fabric. The difficulty, cost and down time associated with attempting to convert such a machine makes such conversions impractical. As a consequence, many knitting companies will be limited to knitting sliver into either high pile fabric or reverse loop fabric, thereby limiting themselves from as much as one half of the potential market. Alternatively, a knitting company will be required to buy two different machines which are each dedicated to a different type of sliver knitting.

If this alternative is chosen, depending on the production requirements of the end customer, up to as many as one half of the expensive circular sliver knitting machines cannot be used and remain idle. Furthermore, the ability to only knit either reverse loop fabric or high pile fabric on a particular circular sliver knitting machine, necessarily limits the number or variety of patterns which may be achieved by the machine.

SUMMARY OF THE INVENTION

In view of the foregoing background, it is therefore an object of the present invention to provide a circular sliver knitting machine which may be easily and efficiently converted to either a reverse loop sliver knit fabric, or a high pile sliver knit fabric depending on the production needs of the manufacturer.

These and other objects, features and advantages of the present invention are obtained by providing a circular sliver knitting machine having a frame which rotatably support a needle cylinder. A plurality of needles are supported in said needle cylinder for rotational movement therewith and for vertical movement parallel to the axis of rotation thereof. A plurality of card units are provided at radially spaced locations along the rotational path of the needle cylinder. Each card unit is positioned to deliver sliver fibers to the needles during their rotation with the needle cylinder. A yarn feeding station is positioned adjacent each of the card units for selectively feeding yarn to the plurality of needles. A plurality of sinkers are also provided which cooperate with the plurality of needles to form the yarn and the sliver fibers into knitted fabric.

The circular sliver knitting machine is also provided with an air supply means which supplies air to the circular sliver knitting machine. An air distributing means is provided for distributing air received from the air supply means to a first air nozzle unit which cooperates with each of the plurality of card units for directing air along a path generally radially outward toward the plurality of needles for turning free ends of the sliver fiber over onto the plurality of sinkers to manufacture reverse loop fabric. A circular sliver knitting machine of this type and a method of forming reverse loop sliver knit fabric is described in detail in U.S. Pat. Nos. 5,431,029 and 5,460,016 assigned to Applicant, which are hereby incorporated herein in their entirety.

In order to avoid unwanted build up of fiber on the first air blowing unit and to improve the ability to quickly adjust the location of the first air blowing unit relative to the associated card unit, it is desirable in an alternative embodiment of the invention to mount the first air blowing unit directly onto the card unit.

In addition, the air supply means can also supply air to a second air nozzle unit which cooperates with each of the plurality of card units for directing air along a path generally radially inward toward the plurality of needles for standing up the free ends of the sliver fiber when manufacturing conventional high pile fabric.

It is also possible to selectively use both the first and second air nozzle units in a predetermined sequence to obtain a variety of unique fabrics having both reverse loops and high piles in a variety of patterns. To improve the ability to obtain the desired variety of patterns using both the first and second air nozzle units, the alternative embodiment of the first air nozzle unit is provided with a plurality of interchangeable bottom plates which can easily be mounted to the bottom of the second air nozzle unit. The interchangeable bottom plates enable the circular sliver knitting machine to quickly be converted to knit a variety of different patterns.

The air directing means of the present invention comprises a cross bar which is attached to the frame of the circular sliver knitting machine. A first cross bar aperture is located therein so as to receive air from the air supply means. The cross bar defines a cavity therein which and has a divider for dividing the cavity. A cover is secured to the cross bar forming a seal therebetween, such that the cover cooperates with the cross bar and the divider for forming a first plenum and a second plenum therebetween. The cover has a first cover aperture for receiving air from the air supply means.

Attachment bars are provided for attaching the cross bar to the frame. At least one of the attachment bars defines a cavity which enables air received from the air supply means to flow therethrough so as to be in fluid communication with the second air nozzle unit. The cross bar also has control means for controlling the flow of air from the air supply means to each of the first and second blowing units. The control means comprises a first adjustable valve located in the cavity formed in the attachment bar so as to distribute the flow of air to each of the second blowing units. The control means also facilitates the distribution of air from the air supply means to the first air nozzle unit through a second adjustable valve located between the cross bar and each of the second air nozzle units.

Preferably the cross bar includes a second cross bar aperture to receive fiber waste laden air which is exhausted or discharged from the circular sliver knitting machine through a second cover aperture.

BRIEF DESCRIPTION OF THE DRAWINGS

Some of the objects, features and advantages of the present invention having been stated, others will appear as the description proceeds, when taken in conjunction with the accompanying drawings in which.

DESCRIPTION OF THE PREFERRED EMBODIMENTS

The present invention will now be described more fully hereinafter with reference to the accompanying drawings, in which the preferred embodiment of the invention is shown. This invention may, however, be embodied in different forms and should not be construed as limited to the embodiments set forth herein. Rather, the illustrative embodiments are provided so that this disclosure will be thorough and complete, and will fully convey the scope of the invention to those skilled in the art. Like numbers refer to like elements throughout.

Overview Of The Circular Sliver Knitting Machine

Figure 1:
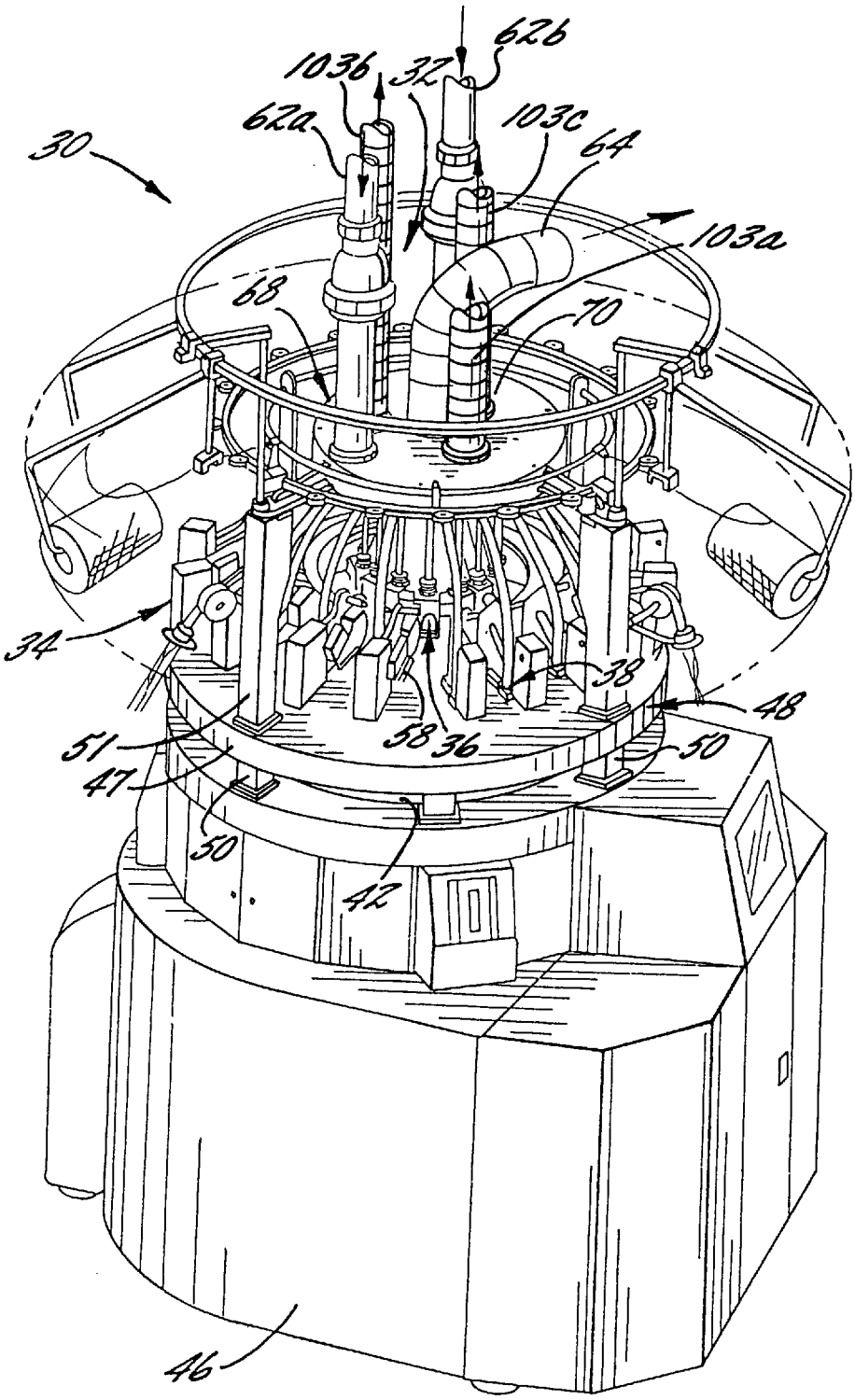
FIG. 1 is a perspective view of the apparatus in accordance with the present invention.

Referring to FIGS. 1 and 2, a circular sliver knitting machine configured for knitting reverse loop sliver fabric and which embodies the features of the present invention is illustrated generally at 30. The components of the machine 30 and the method of manufacturing reverse loop sliver fabric are described in detail in U.S. Pat. No. 5,431,029 to Kuhrau et al. which is incorporated herein by reference.

The machine 30 consists of an air distributing assembly 32, a plurality of card units 34, a plurality of air nozzle units 36, a plurality of first suction units 38, an adjustment assembly 40, and a sinker units/latch guard assembly 44. The machine 30 also includes a base 46 which supports the above recited elements on a frame 48 consisting of six substantially equally spaced stanchions 50 extending upwardly from the base 46 to support a card support ring 47 and a frame plate 42 mounted thereto.

A needle cylinder 52 is rotatably mounted to the machine 30 for rotatably carrying a plurality of needles 54 about an axis parallel to the longitudinal axis of the machine. The needles 54, revolving with the needle cylinder 52, move vertically along a predetermined sinusoidal or wave-like path relative to the card units 34, the blowing units 36, the first suction units 38, and the sinker units/latch guard assembly 44 which are each positioned in spaced locations around the machine 30. The needles 54 are movable between a welt position or clearance level and a knit position or cast-off level. In addition, the needles 54 used in the machine 30 have a short latch, thereby shortening the distance between the needles and the sinker units and latch guard assembly 44.

A plurality of sinkers 56 move generally perpendicular to the vertical movement of the needles 54 and cooperate therewith. Mounted on the frame 48 adjacent each of the card units 34, which feeds sliver fiber to the needles 54 is a yarn feeding station 58 which feeds yarn to the needles 54. An exhaust unit 60 is provided for drawing or sucking fiber waste generated during the manufacturing process, out of the machine 30. Each of the elements briefly outlined above will be described below in greater detail.

The Air Distributing Assembly

The air distributing assembly 32 of the machine 30 is best seen in FIGS. 1 through 7B. The air distributing assembly 32 includes an air supply means or unit, which is represented by a pair of air pipes 62*a* and 62*b* in FIGS. 1 and 2. Each of the air pipes 62*a*, 62*b* is attached to an air pump (positive displacement unit) or fan unit (not shown) which provides air to the machine 30 at a predetermined pressure. An air discharge mechanism, represented by discharge conduit 64 and a plurality of second air discharge conduits 103*a–c* in FIGS. 1 and 2 cooperate with a vacuum motor for sucking or drawing fiber waste laden air from the machine 30.

The air pipes 62*a*, 62*b*, the discharge conduit 64, and the second discharge conduits 103*a–c* cooperate with a manifold 66 which directs the air flow from the air pipe into the machine 30 and directs fiber waste laden air to one or both of the first and second discharge conduits for removal from the machine. The manifold 66 is formed from a cross bar 68 and a cover 70.

As best shown in FIGS. 1 and 2 the cross bar 68 has a generally circular body 72 with three attachment bars 74 equally spaced and extending radially outward therefrom. The attachment bars 74 are attached to the card support ring 47 by three substantially equally spaced supports 51 by means of fasteners (not shown) which cooperate with mounting apertures 76 located in each of the mounting bars. The body 72 defines a cavity 78 which has an annular divider 80 for separating the cavity into a first plenum 82 and a second plenum 84 when the cover 70 is seated onto the body of the cross bar 68. The annular divider 80 divides the cavity 78 so that the first plenum 82 and the second plenum 84 are concentrically arranged, where the second plenum is located radially outward from the first plenum.

A first cross bar aperture 86 is centrally located in the body 72 and has an attachment flange 88 extending downward therefrom for receiving the exhaust unit 60. A plurality of second cross bar apertures 90, are located radially outward from the first cross bar aperture 86, and are equally spaced along the bottom of the first plenum 82 for receiving fiber waste laden air from the first suction units 38. Fiber waste laden air received from the first suction units 38 and the exhaust unit 60 is directed from the first plenum 82 into the cover 70 and out of the machine 30. A plurality of third cross bar apertures 92 are equally spaced along the bottom of the second plenum 84 for directing air from the air supply pipes 62*a*, 62*b* to each of the first air nozzle units 36.

The cover 70 is seated on the body 72 of the cross bar 68 by fasteners (not shown) which are received in corresponding fastening apertures 94*a* and 94*b*, and 95*a* and 95*b*. The cover 70 is seated on the body 72 to ensure that there is an air-tight seal therebetween so that fiber waste laden air received in the first plenum 82 does not flow or leak into the second plenum 84, which is intended to carry clean air from the air supply pipe 62 into the air nozzle units 36, and contaminate the machine 30.

The cover 70 defines a first cover aperture 96 which has a discharge flange 98 extending upward therefrom to receive the air discharge conduit 64. The first cover aperture 96 is in general longitudinal alignment with the first cross bar aperture 86 for directing fiber waste laden air received from first plenum 82 into the air discharge conduit 64 and out of the machine 30. It is to be understood that the fiber waste laden air received from the exhaust unit 60 travels through the air discharge conduit 64 out of the machine and, although not shown, may be filtered to remove and collect the fiber waste and vent the filtered air to atmosphere.

Three second cover apertures 101*a–c*, are spaced generally equidistantly apart above the first plenum 82. The second cover apertures 101*a–c* cooperate with the plurality of second cross bar apertures 90 to receive fiber waste laden air from each of the plurality of first suction units 38 and discharge the fiber waste laden air, through each of the corresponding second air discharge conduits 103*a–c*, from the machine 30. Although not shown, it is to be understood that the discharged fiber waste laden air may be filtered to remove and collect the fiber waste and vent the filtered air to atmosphere.

Figure 2A:
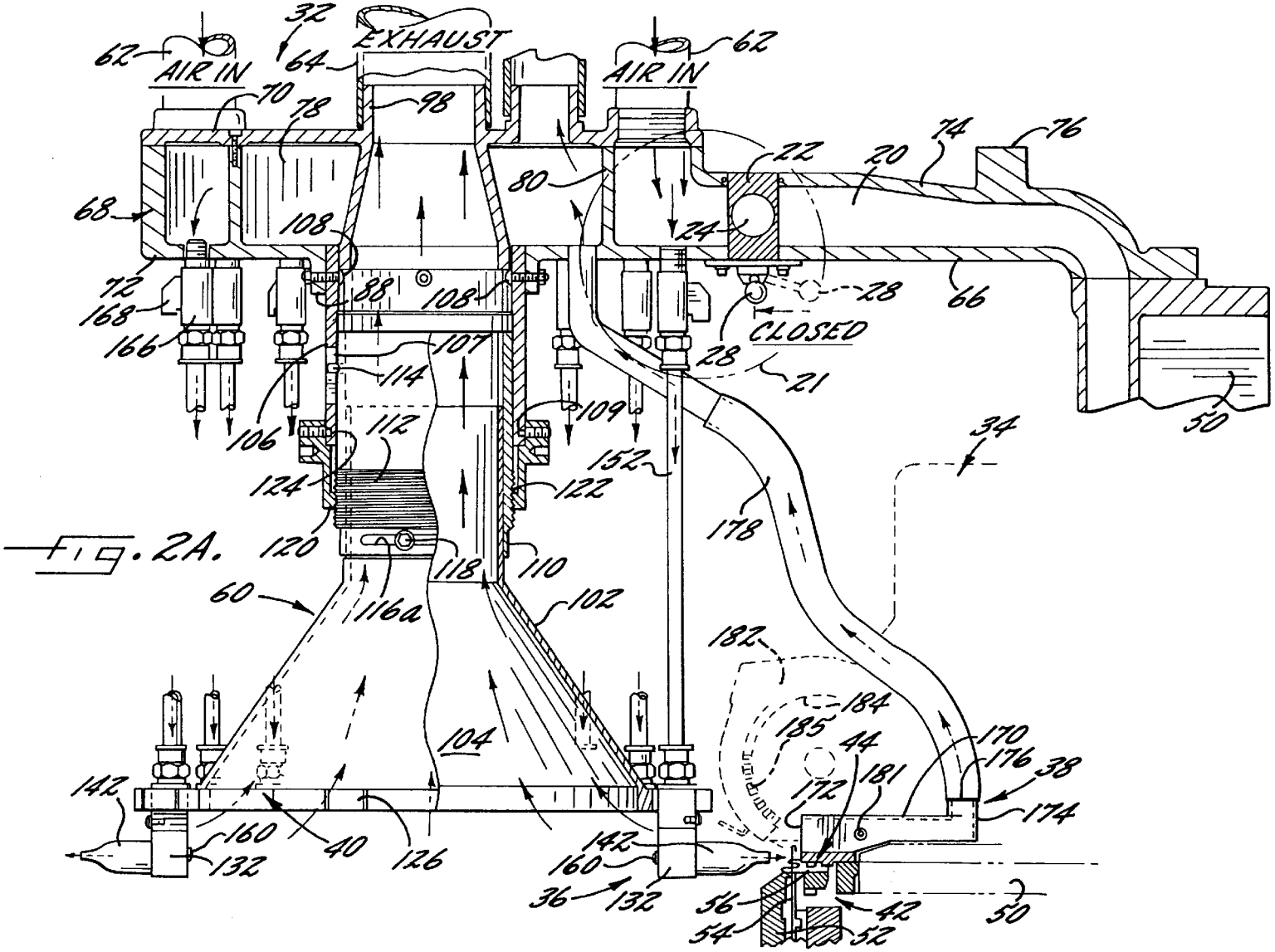
FIG. 2A is a partial cross sectional view of the air distributing means and the suction means of the present invention.
Figure 5:
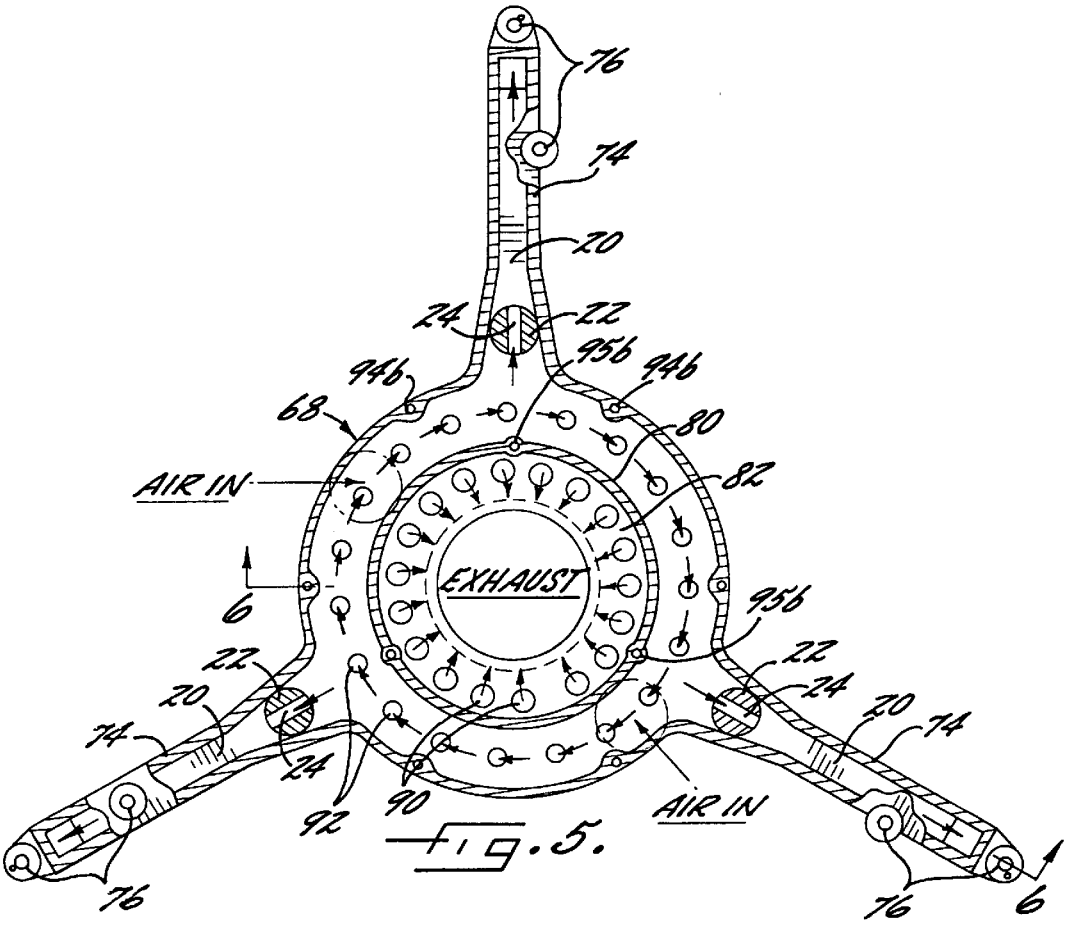
FIG. 5 is a top plan view of the cross bar with the cover of FIG. 3 removed.
Figure 6:
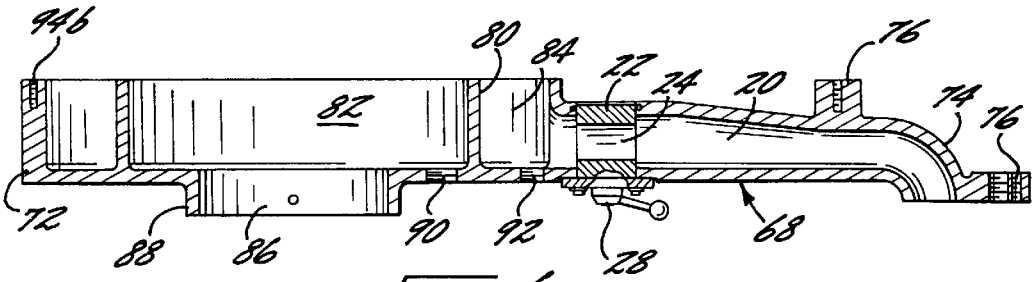
FIG. 6 is a cross sectional view taken along the line 6—6 of FIG. 5.
Figure 7A:
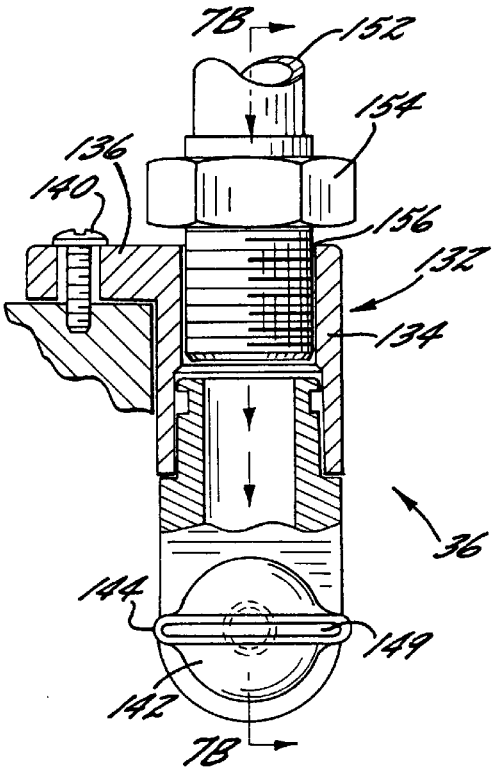
FIG. 7A is a partial cross sectional end view of the first air blow unit.
Figure 8:
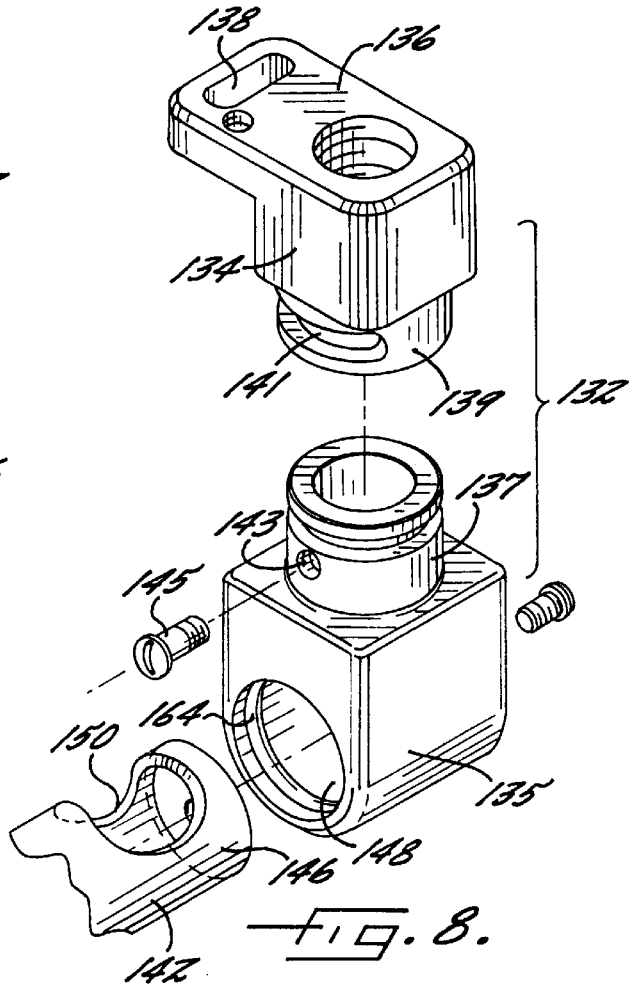
FIG. 8 is an exploded view of the first air nozzle unit.
Figure 7B:
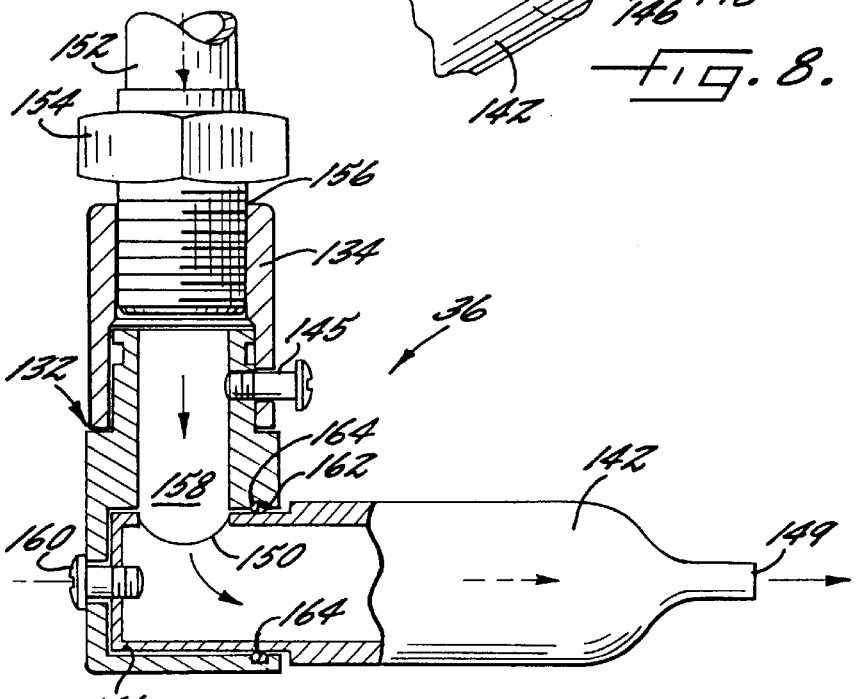
FIG. 7B is a partial cross-sectional side view of the first air nozzle unit.
Figure 9:
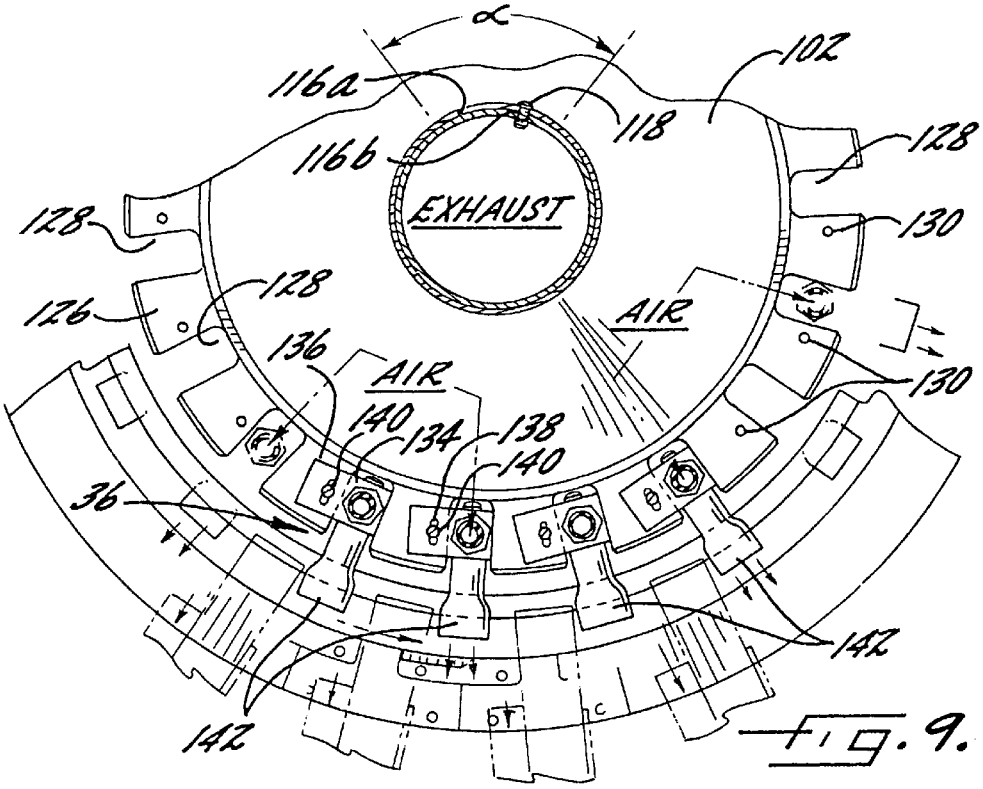
FIG. 9 is a top plan view of the exhaust hood and the support ring showing the configuration of the device when knitting reverse sliver loop fabric.

As best shown in FIGS. 2A, 5, and 6, each of the attachment bars 74 is hollow so as to define a cavity 20 therein which allows air from the air distribution assembly 32 to flow therethrough. The cover 70 defines a pair of third cover apertures 100*a* and 100*b* located above the second plenum 84, receives the air supply pipes 62*a* and 62*b* for supplying air (under a predetermined pressure) into the second plenum. The air is then either directed to each of the second cross bar apertures 92, where it is directed to each of the air nozzle units 36 or the air is directed into the cavity 20 located in each attachment bar 74, where it is directed to each of a plurality of second air nozzle units, shown generally at 26.

A control means 21, in the form of a first adjustable valve 22, is mounted within the cavity 20 so as to be pivotally movable between an OPEN position shown in FIGS., 5 and 6, and a CLOSED position shown in FIG. 2A. When in the OPEN position, a valve aperture 24 is in longitudinal alignment with the cavity 20 to allow air to flow therethrough to each of the second air nozzle units 26. To close the first adjustable valve 22 requires a handle 28 to be rotated 90° so as to position the valve aperture 24 generally transverse to the longitudinal axis of the cavity 20 to prevent air from flowing therethrough.

The Exhaust Unit

The exhaust unit 60, best shown in FIG. 2, includes an exhaust hood 102 which has a generally funnel shape defining a hood opening 104 for sucking fiber waste laden air from the area of the machine 30 radially inward from the blowing units 36. The exhaust unit 60 is secured by an attachment sleeve 106 to the attachment flange 88 of the cross bar 68, by means of fasteners 108. A vertical slot 107 of predetermined length is formed along a portion of the attachment sleeve 106 and a horizontal slot 109 traversing the circumference of the attachment sleeve, is located below the vertical slot 107. Located in between the exhaust hood 102 and the attachment sleeve 106 is a tubular sleeve 110. The tubular sleeve is longitudinally movable relative to the attachment sleeve 106.

The tubular sleeve 110 has a threaded outer surface 112 and located above and projecting outward from the threaded outer surface, is a pin 114. The pin 114 is positioned so as to prevent the exhaust unit 60 from rotating. In addition the pin 114 also limits the vertical travel of the tubular sleeve 110 relative to the attachment sleeve 106. The tubular sleeve 110 also has a horizontally groove 116*a* of predetermined length along its outer surface. In this embodiment, the groove 116*a* is located below the threaded outer surface 112. A corresponding threaded hole 116*b* is located on the exhaust hood 102. A tightening screw 118 is used to selectively release or tighten the exhaust hood 102 relative to the tubular sleeve 110. By loosening the screw 118, the exhaust hood 102 may be rotated within the predetermined distance about a longitudinal axis parallel to the axis of the plurality of needles 54.

An adjusting ring 120 has a threaded end 122, which threadingly engages the threaded outer surface 112 of the tubular sleeve 110. A set screw 124 located at the other end of the adjusting ring 120, which cooperates with the horizontal slot 109 in the attachment sleeve 106. The threaded end 122 and the set screw 124 cooperate to join the adjusting ring 120 with the tubular sleeve 110 and the attachment sleeve 106.

To adjust the vertical height or elevation of the exhaust hood 102, set screw 124 is loosened, and the adjusting ring 120 is rotated in either the clockwise (to raise) or counterclockwise (to lower) direction. As the adjusting ring 120 is rotated, the set screw tracks within the horizontal slot 109 of the adjustment sleeve 106, preventing relative vertical movement therebetween, while enabling the threaded end 122 of the adjusting ring to rotate along the threaded outer surface 112 of the tubular sleeve 106. Vertically fixing the adjusting ring 120, relative to the attachment sleeve 106, allows the tubular sleeve 106 and the exhaust hood 102, which is attached thereto by the tightening screw 118, to be vertically adjusted as threaded end of the adjusting ring engage the threaded outer surface 112 of the tubular sleeve 110. The range of vertical movement is controlled by the length of the vertical slot 107, in which the pin 114 travels until encountering the end of the vertical slot.

A support ring 126 is cast or formed with the flared head of the exhaust hood 102 to form a unitary structure. Therefore, the exhaust hood 102 and the support ring 126 move together as a single unit. The support ring 126 has a plurality of U-shaped notches 128 located in spaced relation about its peripheral surface. The notches 128 receive the air nozzle units 36 described in detail below. Adjacent each of the notches 128 is a mounting aperture 130 for adjustably mounting the air nozzle units 36. The rotational adjustment of the exhaust hood 102 relative to the tubular sleeve 110 results in a lateral displacement or movement of each air nozzle unit 36, by virtue of being mounted on the support ring 126, relative to the needles 54 of at least three inches. The threads on the outer threaded surface 112 of the tubular sleeve 110 and the threaded end 122 of the adjusting ring 120 are very fine such that movement of the exhaust hood 102 and the support ring 126 attached thereto, results in a maximum vertical adjustment of the air nozzle units 36, relative to the needles 54, of at least one inch. Therefore, it may be seen that any adjustments made to the air nozzle units 36 are very fine. Although the adjustments are very fine, any adjustment to the air nozzle units 36 has a dramatic effect on the quality and nature of the reverse loop sliver knit fabric being produced. Accordingly, the ability to simultaneously move all of the air nozzle units 36 relative to the needles 54 is a major improvement, in time and cost savings, over past techniques which required individual adjustment of each air nozzle unit.

The Air Nozzle Units

The present invention incorporates a first air nozzle unit 36 which is best seen in FIGS. 1, 2A, and 7A–10. The air nozzle unit 36 includes a mounting assembly generally indicated as 132 has a generally rectangular configuration wherein a longitudinal axis thereof is generally parallel to the plurality of needles 54. A first mounting member 134 has a mounting flange 136 for mounting the mounting assembly 132 to the support ring 126. Within the mounting flange 136 is defined a horizontal adjustment slot 138 which cooperates with the mounting aperture 130 of the support ring 126 for receiving a fastener 140. The cooperation between the fastener 140 and the mounting flange 136 enables the block to be horizontally adjusted for controlling the radial distance between an air nozzle 142 and the plurality of needles 54. Once the desired distance therebetween has been achieved, the fastener 140 is tightened to secure the mounting assembly 132 in place. The maximum distance between the air nozzle 142 and the needles 54 is approximately one inch. Accordingly, any horizontal adjustment to air nozzle 142 must be within this limited range.

A second mounting member 135 has an attachment extension 137 which is slidably received within a corresponding extension 139 of the first mounting member 134. An adjustment slot 141 is formed in the extension 139 of the first mounting member 134. A corresponding aperture 143 is located in the attachment extension 137 of the second mounting member 135. A screw 145 is positioned within the aperture 143 once the first and second mounting members are slidably joined thereby allowing the screw to travel within the adjustment slot 141 so as to allow the first air nozzle unit 36 to be pivotally adjustable about a vertical axis relative to the needles 54.

The air nozzle 142 has a first end 144 located adjacent the needles 54. The air nozzle 142 has a second end 146 which is received within a receiving cavity 148 in the mounting assembly 132, so as to orient the air nozzle 142 generally perpendicular to the mounting assembly. A first opening 149 is located in the first end, and a second opening 150 is formed in the second end of the air nozzle 142, to enable air to flow therethrough.

An air supply hose 152 fluidly connects the second plenum 84 of the manifold 66 and the block 132. The air supply hose 152 has a threaded fitting 154 received in a correspondingly threaded aperture 156 located in the first end 134 of the block 132. Between the threaded aperture 156 and the cavity 146 is an air channel 158 enabling air to flow directly from the air supply pipe 62, through the manifold 66, through the air supply hose 152, through the block 132, through the second opening 150 and to the first opening 149 of the air nozzle 142 and onto the needles 54.

In addition to being able to control the distance between the first end 144 of the air nozzle 142 and the needles 54, by means of the cooperation between the mounting flange 136, the horizontal adjustment slot 138, and the fastener 140, the pivotal or rotational orientation of the air nozzle may also be adjusted relative to the needle line. This orientation of the air nozzle 142 relative to the needles 54 may be achieved by cooperation between a screw 160, located on the block 132 adjacent the second end 146 of the air nozzle, a circular groove 162 located in the block adjacent the first end 144 of the air nozzle and an o-ring 164 located on the air nozzle toward the second end thereof.

To adjust the pivotal orientation of the air nozzle 142, the screw 160 is loosened to allow the air nozzle to rotate around its longitudinal axis, such that the o-ring 164 travels within the circular groove 162 preventing any corresponding horizontal movement of the air nozzle. As shown by the phantom lines in FIG. 9, once the desired orientation of the air nozzle has been achieved, the screw 160 is tightened to retain the air nozzle in this position.

Located in between the second plenum 84 of the manifold 66 and the air supply hose 152 is a control valve 166. In FIG. 2 it may be seen that the control valve 166 is fitted into the third cross bar aperture 92 to receive a flow of air from the second plenum 84. The air received therefrom is under a predetermined pressure received from the air supply pipe 62. The control valve 166 is of a mini ball valve type, such that a control knob 168 may control the rate of air flow to the air nozzle 142 ranging between a CLOSED position and an OPEN position. The benefit of using a variable control valve 166 is that it allows the machine 30 operator to individually control the air flow to all or a predetermined number of air nozzles 142. The variable control valve also allows the operator to compensate for any loss in pressure gradient in one or more of the air nozzles 142 by slightly closing those air nozzles not experiences any pressure loss to equalize the flow to all of the air nozzles. In addition, if desirable, for production of different fabrics or variations within a fabric, it is possible to intentionally vary the air flow rate to all or some of the air nozzles 142. Alternatively, it is possible to combine the control valve 166 with an electronic controller to selectively vary the air flow or provide an intermittent air flow when desired.

The first air nozzle unit 36 of the embodiment of the invention shown in FIGS. 1 and 2, is located radially inward from the needles 54 and directs air radially outward in a directly longitudinal and horizontal direction to turn the free end of the sliver X once one or more courses have been knit to obtain a fabric having a reverse loop sliver. As discussed below, it is also possible to activate both the first and second air nozzle units 36 and 26 to obtain a new variety of fabric patterns.

A second embodiment of the first air nozzle unit 36' on the invention is shown in FIGS. 11 through 17. The first air nozzle unit 36' includes a mounting assembly generally indicated as 132' having a longitudinal axis thereof generally perpendicular to the plurality of needles 54. A first mounting member 134' has a generally rectangular configuration defining a coupling 154' at its first end to receive the air supply hose 152' and defining an opening 139' at its second end.

A second mounting member 135' has an attachment extension 137' which is slidably received within the opening 139' defined in the first mounting member 134'. A second opening 143' is located in the first mounting member 134', which threadingly receives a screw 145' once the first and second mounting members are slidably joined. The attachment extension 137' has a groove 141' formed therein for receiving the screw 145' to thereby allow the screw to travel within the groove 141 so as to allow the first air nozzle unit 36' to be pivotally adjustable about a vertical axis relative to the needles 54.

The air nozzle 142' has a first end 144' located adjacent the needles 54. The air nozzle 142' is has a second end 146' which is received within a receiving cavity 148' in the mounting assembly 132', so as to orient the air nozzle 142' generally perpendicular to the mounting assembly. A first opening 149' is located in the first end, and a second opening 150' is formed in the second end of the air nozzle 142', to enable air to flow therethrough.

An air supply hose 152' fluidly connects the second plenum 84 of the manifold 66 and the mounting assembly 132'. The air supply hose 152' is received on the coupling 154' located in the first mounting member 134' of the mounting assembly 132'. An air channel 158' in the first mounting member 134' enables air to flow directly from the air supply pipe 62, through the manifold 66, through the air supply hose 152', through the first mounting member 134', through the second opening 150' and to the first opening 149' of the air nozzle 142' and onto the needles 54.

This embodiment of the first air nozzle 36' also includes a base plate 190 which is attached to the base of the air nozzle 142' by a pair of fasteners 192. The base plate 190 cooperates with the first end 144' of the air nozzle 142' to define the generally rectangular shape of the first opening 149'. In this embodiment, the base plate 190 has a generally rectangular configuration corresponding to the generally rectangularly shaped air nozzle 142'. It is to be understood that the shape of the air nozzle 142', the first end 144', the first opening 149', and the base plate may vary depending on desire an remain within the spirit of the present invention. The base plate 190 is also intended to cover the bottom of the first opening 149' to ensure that the air is properly directed toward the plurality of needles 54.

Figure 14:
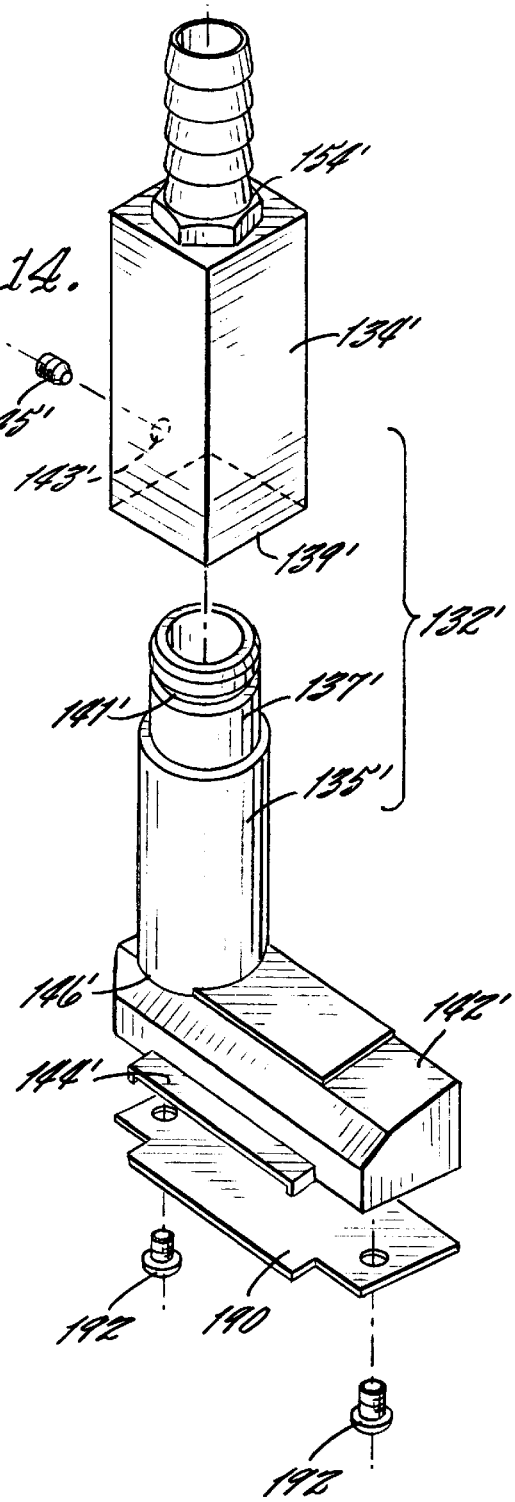
FIG. 14 is an exploded view of the first air nozzle unit shown in FIG. 13.

As best shown in FIG. 14, the cavity 148' directs air into the second opening 150' where it travels substantially horizontally along an air passage 151' and then to the first opening 149' where it is directed toward the plurality of needles 54. The air passage 151' in conjunction with the shape of the first opening 149', ensures that the air is equally distributed within the first end 144' of the air nozzle 142' before it is expelled toward the plurality of needles 54 through the first opening. The resultant air pattern ensures that the free ends of the sliver X are moved efficiently in the desired direction. The size of the first opening 149' may vary as desired and still remain within the spirit of the invention, however in the present embodiment of the invention, the first opening is approximately 1.5 mm in size.

Figure 15:
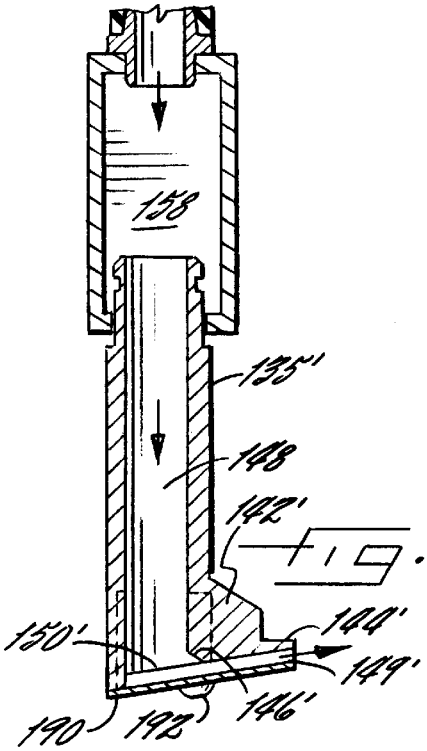
FIG. 15 is a side view in cross section taken along line 15—15 of FIG. 14.
Figure 16:
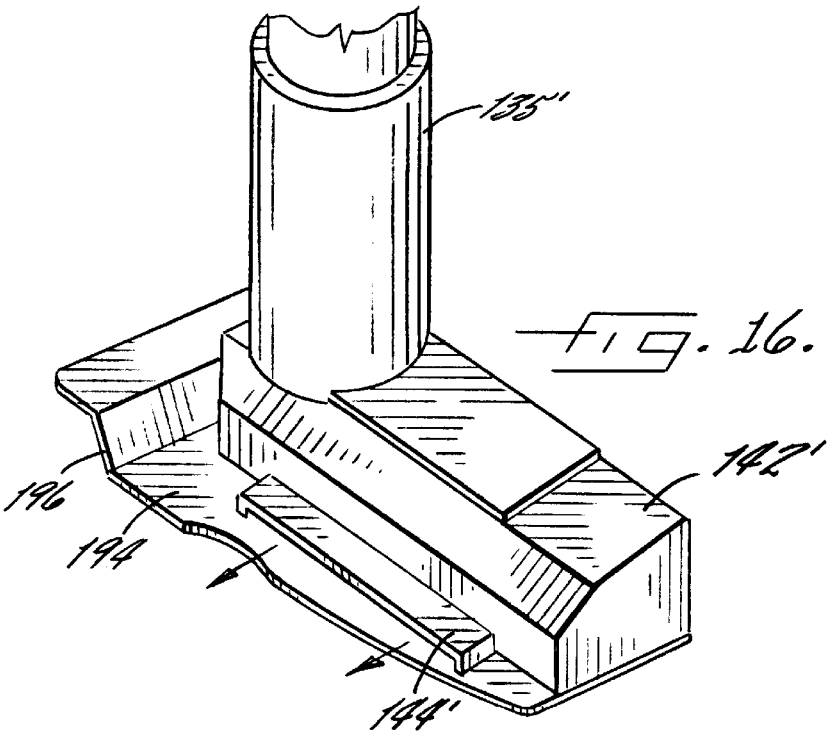
FIG. 16 is a partial side view in perspective of a second base plate to be used with the first air nozzle unit shown in FIG. 11.
Figure 17:
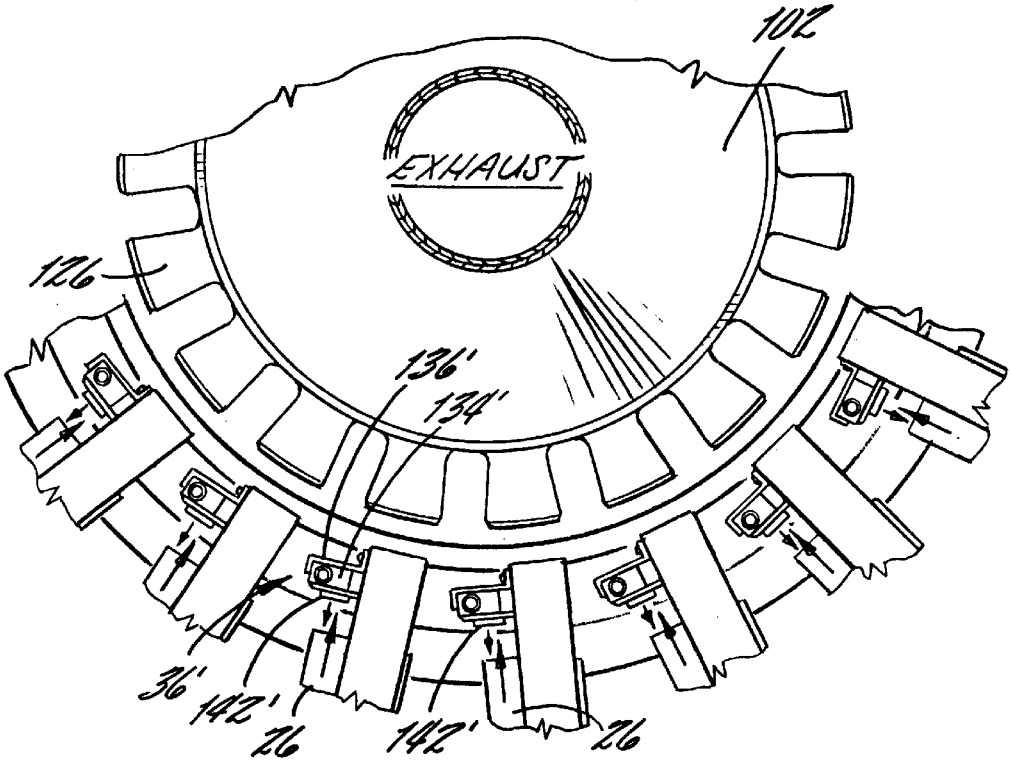
FIG. 17 is a top plan view showing the configuration of the alternative embodiment of the device when a knitting pattern requiring reverse sliver loop fabric and conventional high pile sliver fabric.

This efficient movement of the free ends of the sliver X is enhanced by the upward incline of the bottom portion of the air nozzle 142'. As shown in FIG. 15, the base plate 190 is connected to the air nozzle 142' at an upwardly inclined angle toward the plurality of needles 54. The air is thereby directed toward the base of the fibers to thereby improve its ability to turn over the free ends of the sliver X. In the present embodiment, the incline angle of the air nozzle 142' at the first opening 149' may be between 0° and 25°. However, an angle approaching 15° is preferred.

A mounting bracket 136' is provided for mounting the mounting assembly 132' to the card unit 34'. Within the mounting bracket 136' is defined a threaded aperture 139' which cooperates with a correspondingly threaded aperture 139 in the card unit 34' for receiving a fastener 140'. The cooperation between the fastener 140' and the mounting bracket 136' enables the first air nozzle unit 36' to be horizontally and vertically adjusted for controlling the distance between the first air nozzle 142' and the plurality of needles 54. Once the desired distance therebetween has been achieved, the fastener 140' is tightened to secure the mounting assembly 132' in place. The maximum radial distance between the air nozzle 142' and the needles 54 is approximately one inch. Accordingly, any horizontal adjustment to air nozzle 142' must be within this limited range.

A portion of the card unit 34' is milled in a generally rectangular configuration corresponding in shape and size to the mounting assembly 132' of the first air nozzle unit 36'. This milled out portion enables the first air nozzle unit 36' to more readily be moved vertically and/or horizontally relative to the plurality of needles 54 once the screw 140' on the mounting bracket 136' has been loosened. The shape and size of the milled portion of the card unit 34' limits the amount of horizontal adjustment which is possible. It is to be understood that the first air nozzle unit 36' may be attached to the card unit 34' in a number of alternative ways and may be adjusted vertically, horizontally, and pivotally relative to the plurality of needles 54 by a wide variety of alternative means without departing from the spirit of the present invention. If desired, the attachment means may include the use of one or more positioning gauges to assist in readily locating the first air nozzle unit 36' in its desired location depending on the fabric pattern desired.

As in the first embodiment of the first air nozzle unit 36, this embodiment of the first air nozzle unit 36' relies on the control valve 166 to control the rate of air flow to the air nozzle 142' ranging between a CLOSED position and an OPEN position, in the same manner as previously discussed.

Figure 11:
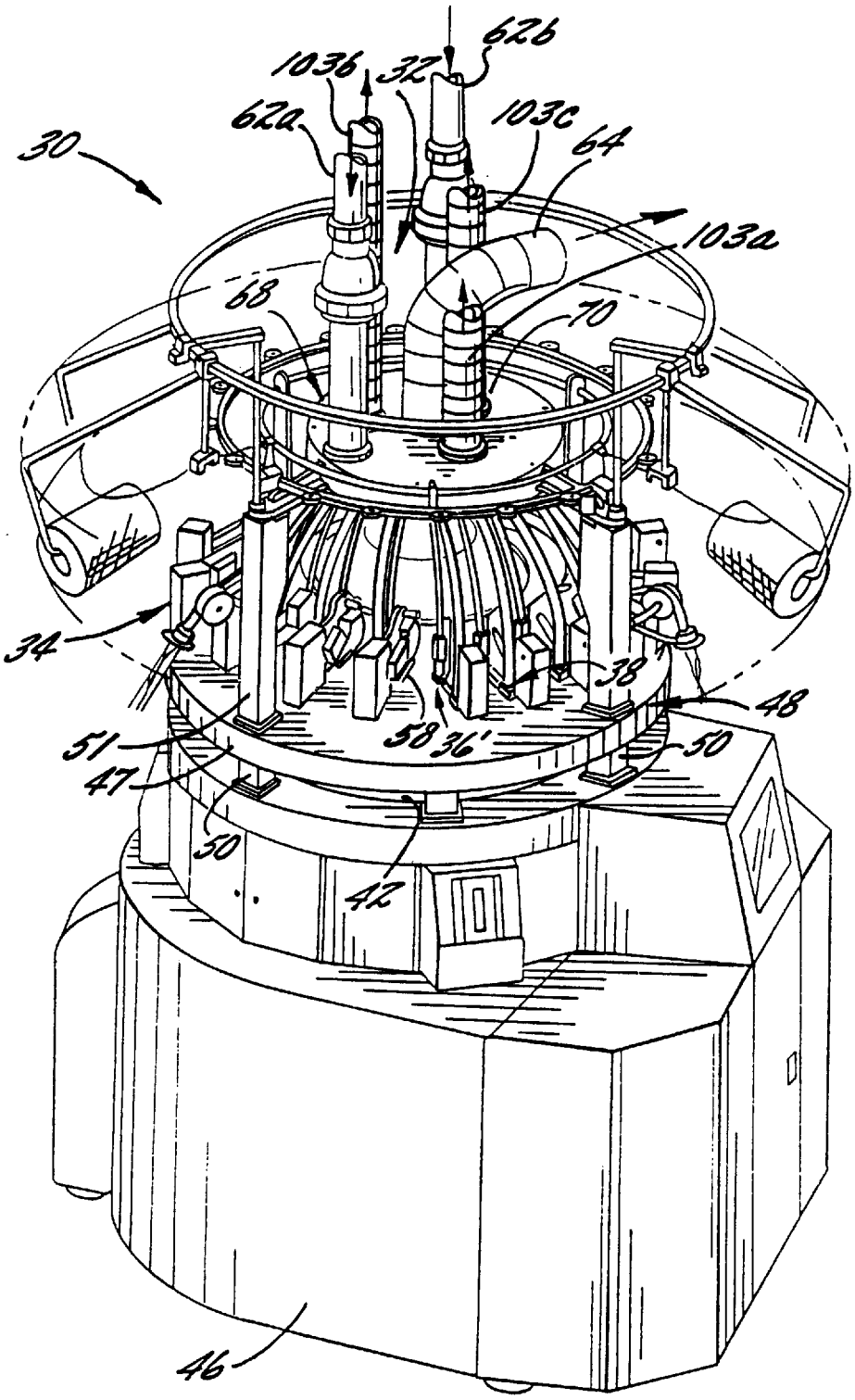
FIG. 11 is a perspective view of the apparatus in accordance with an alternative embodiment of the present invention.
Figure 12:
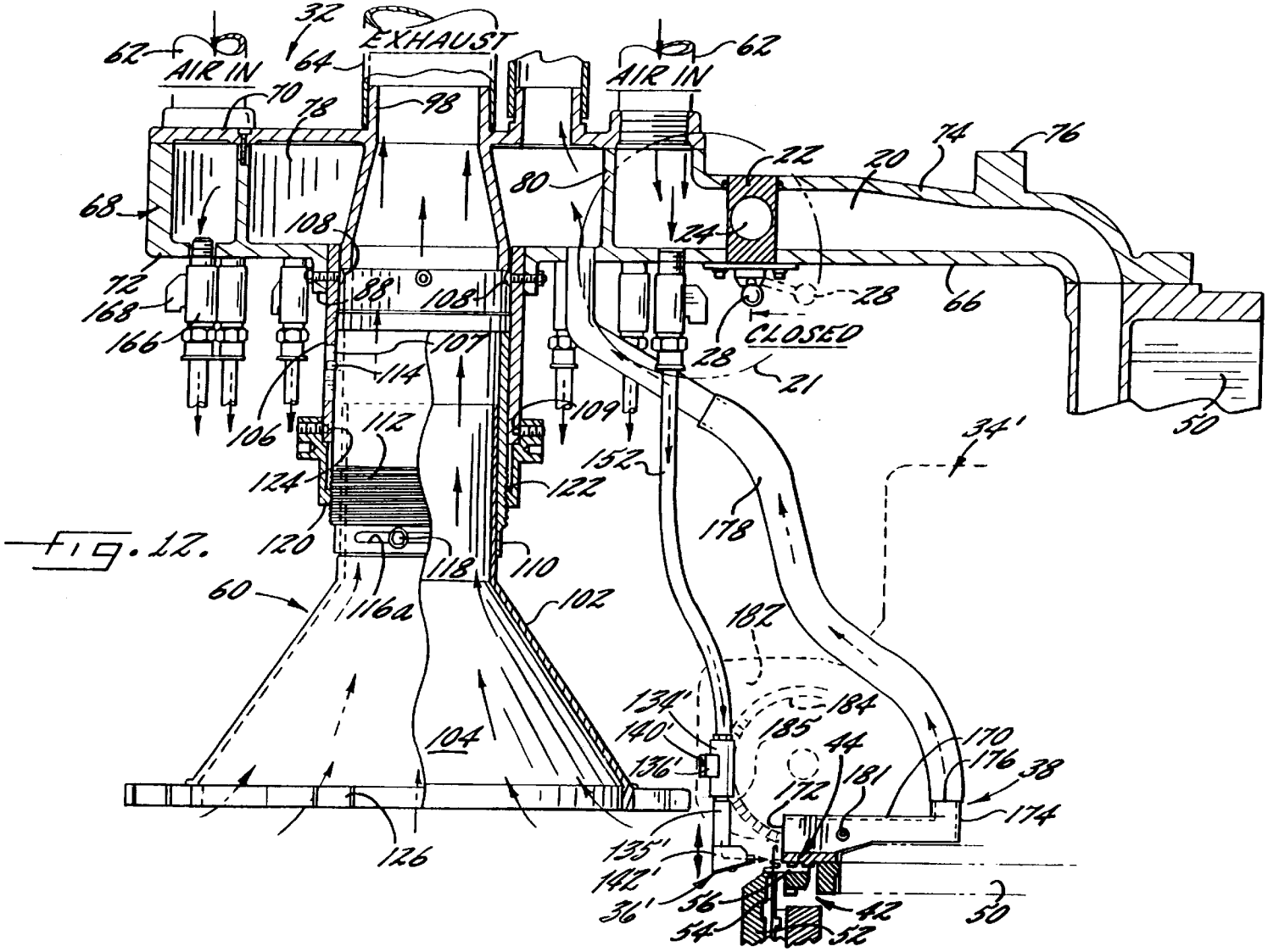
FIG. 12 is a partial cross sectional view of the air distributing means and the suction means of the alternative embodiment of the present invention.
Figure 13:
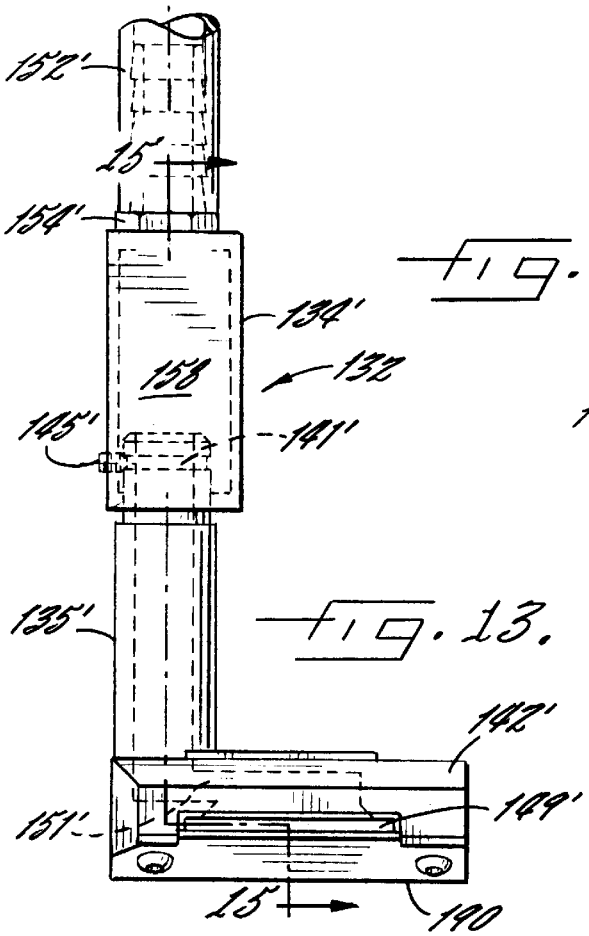
FIG. 13 is a front view of the alternative embodiment of the first air nozzle unit.

The first air nozzle unit 36' of this embodiment of the invention shown in FIGS. 11 and 12, is attached directly to the card unit 44', is located radially inward from the needles 54 and directs air radially outward in a directly longitudinal and horizontal direction to turn the free end of the sliver X once one or more courses have been knit to obtain a fabric having a reverse loop sliver.

As discussed above, it is possible to activate both the first and second air nozzle units 36' and 26 to obtain a new variety of fabric patterns. When both the first and second air nozzle units 36' are to be used, a second interchangeable base plate 194 is used in place of the base plate 190 discussed above. The second base plate 194 has a configuration similar to that of the first base plate 190 with the addition of a ski 196 extending outward therefrom. The ski 196 has a generally rectangular configuration when seen in top plan view and has a generally L-shaped configuration in cross section. The purpose of the ski 196 is to hold down or maintain the pile fiber below the ski, i.e., prevent the pile fiber from being cast off of the plurality of needles 54 at the stitch point, so that the pile fiber will not be turned by the second air nozzle unit 26 and subsequently knit with the broucle fiber. If this second knitting of the pile fiber occurs, the desired pattern, i.e., the "high-low fabric" will not be achieved. Although it is possible to do conventional sliver knitting as discussed above with the second base plate 194, it is preferable that all such conventional knitting be performed with the first base plate 190 connected to the air nozzle 142'.

Figure 2B:
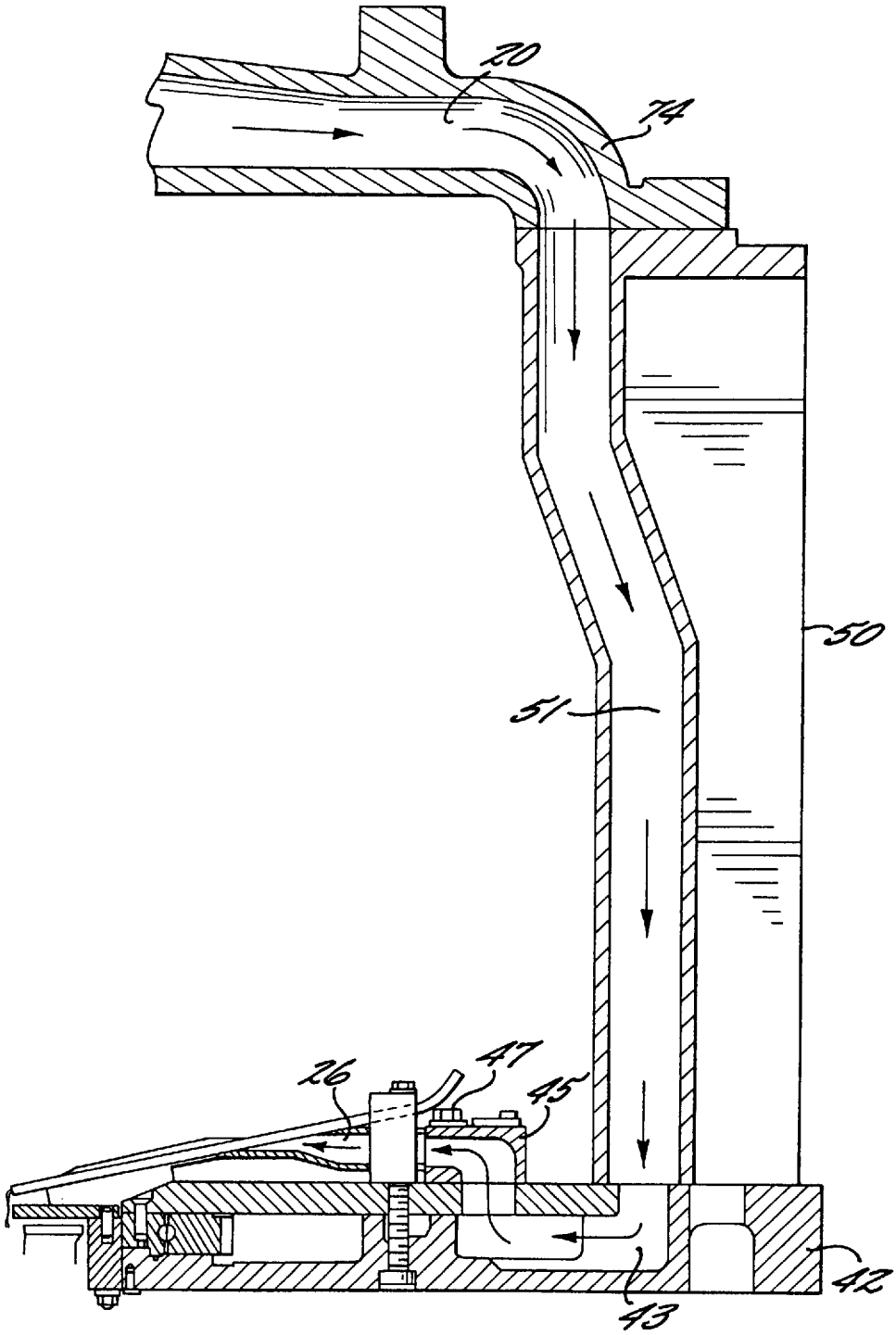
FIG. 2B is a partial cross-sectional view of the second air nozzle unit in accordance with the invention.
Figure 3:
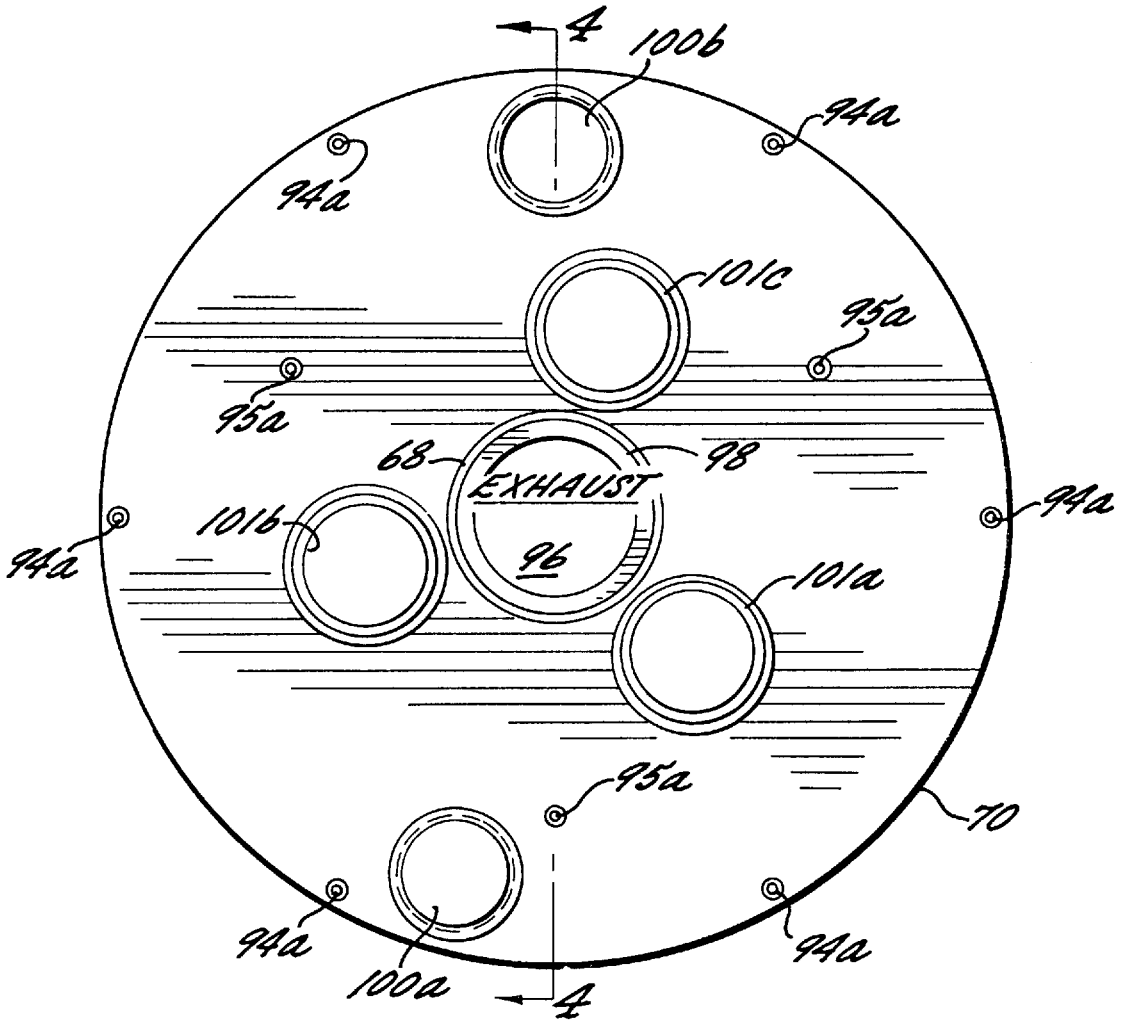
FIG. 3 is a top plan view of the cover of the air distributing means shown in FIG. 2A.
Figure 4:
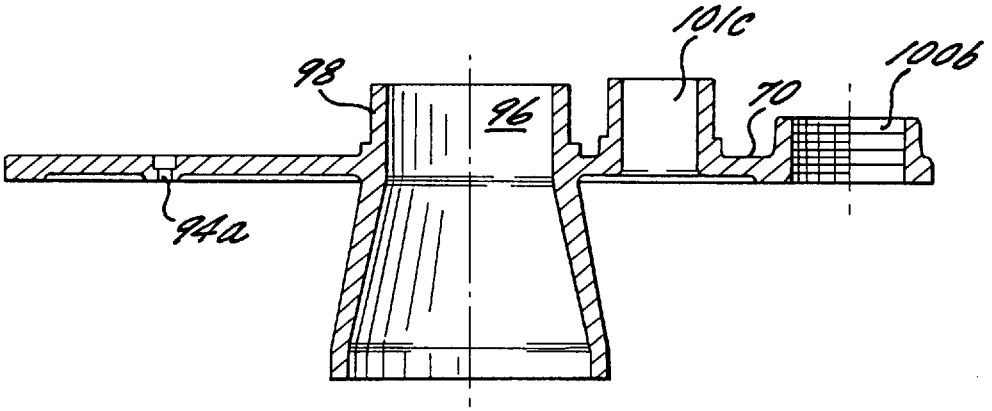
FIG. 4 is a cross sectional view taken along the line 4—4 of FIG. 3.
Figure 10:
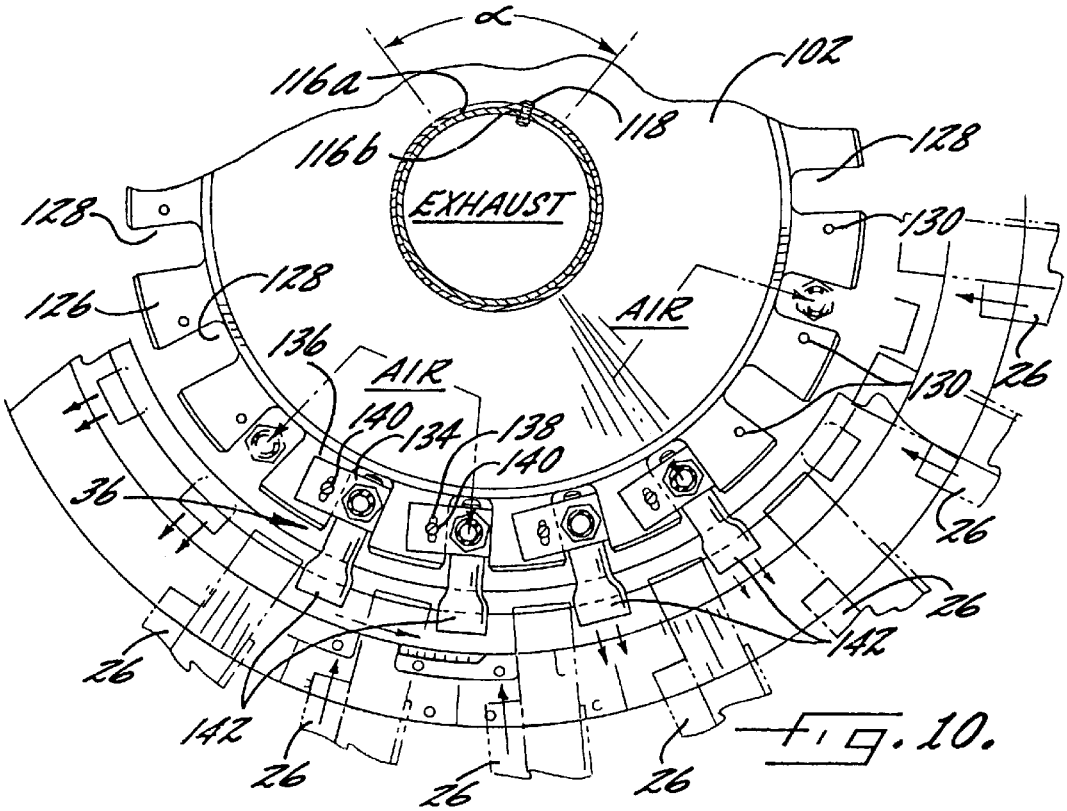
FIG. 10 is a top plan view of the exhaust hood and the support ring showing the configuration of the device when knitting reverse sliver loop fabric and when knitting conventional high pile sliver fabric.

The second air nozzle unit 26 is best shown in FIGS. 2B and 10. As shown in FIG. 10, there may be as many as 18 or more second air nozzle units 26 used on the circular sliver knitting machine 30. Since each of the second air nozzle units are identical, only one of the second air nozzle units will be described below.

The stanchion 50 is mounted between the cross bar 66 and an upper bed 42 of the needle cylinder. The stanchion 50 not only supports the cross bar 66 but also is hollow to form an air conduit 51 to guide air from the cavity 20 of the attachment bar 74, through cavity 43 of the upper bed 42, to the second air nozzle unit 26.

The second air nozzle unit 26 is attached to the upper bed 42 by means of an attachment block 45 which is secured to the upper bed by a fastener 47 such as a bolt or screw. The second air nozzle unit 26 is positioned on the machine 30 so as to be located radially outward of the needles 54 such that it directs air from the air distribution assembly 32 radially inward toward the exhaust unit 60. In this embodiment, it is necessary to first remove the first suction units 38 to position the second air nozzle units 26 in the desired location.

To have air flow out of the second air nozzle unit 26 requires the second adjustable valve 168 to be moved to the CLOSED position so that air does not get distributed to the first air nozzle units 36. In addition, the first adjustable valve 22 must be moved to the OPEN position to allow air to flow from the air distribution assembly 32 through the attachment bars 74, down the stanchion 50, through the upper bed 42 and out of the second air nozzle unit 26. The second air nozzle unit 26 is used when the circular sliver knitting machine 30 is to be used for knitting conventional high pile fabrics. In addition, as shown in FIG. 10, the second air nozzle units 26 can be used in conjunction with the first air nozzle units 36 in a predetermined or random arrangement, so long as they are not both activated on the same station, to create a fabric having a pattern containing both reverse loop sliver and high pile sliver.

The First Suction Unit

The first suction unit 38 is best shown in FIG. 2. As shown, the first suction unit 38 consists of a suction nozzle 170 which is attached to one side of the card unit 34. The suction nozzle 170 has an open end 172 adjacent the needles 54 and a closed end 174. The closed end 174 defines an opening 176 for receiving a discharge hose 178. The discharge hose 178 connects the suction nozzle 170 to the first plenum 82 of the manifold 66 to enable fiber waste laden air collected by the suction nozzle to be transported to the air discharge conduit 64.

The orientation of the air nozzle unit 36, as set forth in the present embodiment of the invention, has resulted in the addition of a first suction unit 38. As illustrated in FIG. 2, the orientation of the suction nozzle 170 is such that it is located radially outward and laterally offset from the air nozzle 142. The first suction unit 38 is connected, by means of a fastener 181, to the card unit 34. The advantage of positioning the first suction unit 38 adjacent the card unit 34 is that fiber waste blown radially outward by the air nozzle unit 36, would otherwise become trapped in the sinkers 56 and the card unit 34.

The use of the first suction unit 38 in conjunction with each card unit 34 eliminates much of the fiber waste radially outward of the air nozzle units 36. The fiber waste located radially inward of the air nozzle units 36 is substantially eliminated by the exhaust unit 60 (i.e., the second suction means). Therefore, the cooperation between the first suction unit 38 and the exhaust unit 60 results in an efficient method of eliminating fiber waste generated by the production from the machine 30. This is especially important in light of the fact that as many as eighteen card units are capable of being operated simultaneously (as is shown in the present embodiment of the invention). In order to use the second air nozzle units 26, it is necessary that the first suction unit 38 be removed from the upper bed 42 of the machine 30 and be replaced by the second air nozzle units. When this occurs, the machine 30 relies on the exhaust unit 60 to withdraw the waste fiber laden air.

The Card Unit

As illustrated in FIGS. 1 and 2, the card unit 34 of the present invention has a card unit housing 182 rotatably retaining a doffer roll 184. The card unit 34 feeds sliver fibers to a wire face 185 of the doffer roll 184, for presenting the sliver fibers to the needles 54 as the needles pass therethrough.

The card unit housing 182 has a substantially flat base in general horizontal alignment with the suction nozzle 170. A yarn feeding tube (not shown) is connected to a card support ring radially outward from the sinker units. The yarn feeding station feeds yarn through the yarn feeding tube to the needles 54 after they have taken sliver fiber from the wire face 185 of the doffer roll 184.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

What is claimed is:

1. An air nozzle unit for use with a circular sliver knitting machine of the type having a frame for rotatably supporting a needle cylinder, the needle cylinder having a plurality of needles vertically movable along a predetermined path relative thereto, a yarn and sliver fiber feeding station, and a plurality of sinkers cooperating therewith for forming sliver fibers into knitted fabric, and having an air supply unit, said air nozzle unit comprising:

a mounting assembly having a coupling for receiving the air supply unit at a first end thereof and defining a first opening at an opposite end thereof, said mounting assembly defining a cavity therethrough for directing air from the air supply unit toward the plurality of needles through said first opening, said mounting assembly further including one of a plurality of selectively interchangeable base plates for use in knitting at least one of a plurality of selected fabric patterns.

2. An air nozzle unit according to claim 1 wherein one of said interchangeable base plates includes a ski for use in retaining the fabric on the needles to knit a selected high-low fabric pattern.

3. An air nozzle unit according to claim 1 wherein said first opening of said air nozzle unit is angled upward.

4. An air nozzle unit according to claim 3 wherein said first opening of said air nozzle unit is angled upward toward at an angle between 0° and 20°.

* * * * *